United States Patent [19]

Toda et al.

[11] Patent Number: 4,931,602

[45] Date of Patent: Jun. 5, 1990

[54] MULTIPOLE CIRCUIT BREAKER

[75] Inventors: Haruhisa Toda; Kouhei Fujiwara; Setsuo Hosogai; Kazumi Shioguchi, all of Hiroshima, Japan

[73] Assignee: Mitsubishi Denki Kabushiki Kaisha, Tokyo, Japan

[21] Appl. No.: 187,127

[22] Filed: Apr. 28, 1988

[30] Foreign Application Priority Data

| | | | |
|---|---|---|---|
| May 28, 1987 | [JP] | Japan | 62-84271 |
| May 28, 1987 | [JP] | Japan | 62-84270 |
| May 28, 1987 | [JP] | Japan | 62-84283 |
| May 28, 1987 | [JP] | Japan | 62-84272 |
| May 28, 1987 | [JP] | Japan | 62-84273 |

[51] Int. Cl.[5] ..... H01H 33/02

[52] U.S. Cl. ..... 200/144 R; 335/13

[58] Field of Search ..... 200/144 R, 147 R; 335/13

[56] References Cited

U.S. PATENT DOCUMENTS 3,958,095 5/1976 Zaffrann et al. ..... 200/144 R 4,778,959 10/1988 Sabatella et al. ..... 200/144 R

*Primary Examiner*—Robert S. Macon

*Attorney, Agent, or Firm*—Sughrue, Mion, Zinn, Macpeak & Seas

[57] ABSTRACT

A multipole circuit breaker of a type with a mechanism pole having a switching mechanism in which adjacent poles are disposed in opposition to the mechanism pole with an interphase wall therebetween and each having an internal attachment such as an alarm switch or the like but no switching mechanism. A latch engages a cradle of the switching mechanism and is arranged to be actuated by an automatic tripping device. A supporting shaft rotatably supports the latch, an a lever fixed on the supporting shaft engages the cradle. Actuators are fixed on the supporting shaft so as to engage the internal attachment of the respect adjacent poles. The supporting shaft is made of metal. Insulating caps are inserted and fixed onto end portions of the supporting shaft, the supporting shaft passing at portions of the insulating caps through the interphase walls. The actuators are inserted and fixed onto the insulating caps.

11 Claims, 16 Drawing Sheets

MULTIPOLE CIRCUIT BREAKER

BACKGROUND OF THE INVENTION

The present invention relates to a multipole circuit breaker provided with a mechanism pole having a switching mechanism and adjacent poles, each disposed in opposition to the mechanism pole with an interphase wall disposed therebetween and each having an internal attachment such as an alarm switch or the like but having no switching mechanism.

FIGS. 1 through 5 show a conventional multipole circuit breaker as disclosed, for example, in Japanese Utility Model application No. 61-122792, of which FIG. 1 is a front view, FIG. 2 is an enlarged cross section taken on a line II—II in FIG. 1, FIG. 3 is an enlarged cross section taken on a line III—III in FIG. 1, FIG. 4 is a partial view of FIG. 2 showing a tripped state, FIG. 5 is a partial view of FIG. 3 showing a striped state, FIG. 6 is a perspective view of the supporting shaft with the lever attached thereon, FIG. 7 is a sectional view taken on line VII—VII in FIG. 6, and FIG. 8 is a perspective view of the supporting shaft.

In these drawings, a circuit breaker casing 1, constituted by a base 1*a* and a cover 1*b*, is provided with a pole 1A having a switching mechanism and an adjacent pole 1B having an alarm switch but having no switching mechanism. Reference numeral 2 designates a power source side fixed electric conductor fixed on the base 1*a*, 3 designates a fixed contact fixedly attached to the fixed electric conductor 2, and 4 designates an automatic tripping device in which, for example, a mechanism (not shown) of the thermal electromagnetic type or of the electronic type is employed. Reference numeral 5 designates a load side fixed electric conductor connected to the automatic tripping device 4, 6 designates a movable contact, 7 designates a moving element to which the movable contact 6 is fixed, 8 designates a flexible electric conductor for connecting the moving element 7 to the automatic tripping device 4 through a connecting electric conductor 9, and 10 designates a contact arm for holding the moving element 7. The contact arm 10 is divided into a first contact arm 10*a* connected to a switching mechanism (described below) and a second contact arm 10*b* for rotatably supporting the moving element 7 with a first pin 11. Reference numeral 12 designates a supporting shaft of the contact arm 10 for rotatably supporting the first and second contact arms 10*a* and 10*b*. Reference numeral 13 designates a crossbar for connecting the first contact arms 10*a* of the poles to each other, 14 designates a guide hole formed through the first contact arm 10*a* extending in the circuit breaking direction, and 15 designates an elongated hole formed through the second contact arm 10*b* extending transversely to the guide hole 14. Reference numeral 16 designates a second pin engaged between the guide hole 4 and the elongated hole 15, and 17 designates an tension spring provided between the first and second pins 11 and 16 which provides a spring force on the second pin 16. Reference numeral 18 designates a pressing spring provided between the moving element 7 and the second contact arm 10*b*, 19 designates an operating handle of the breaker, and 20 designates a switching mechanism of the breaker constituted by a cradle 20*a*, an upper link 20*b*, and a lower link 20*c*. Reference numeral 21 designates a stopper pin provided on the cradle 20*a*, 22 designates a connecting pin for connecting the lower link 20*c* to the first contact arm 10*a*, 23 designates an arc-extinguishing chamber, and 24 designates a latch rotatably supported by a supporting shaft 25 for engaging with the cradle 20*a*. Reference numeral 26 designates a trip bar latch of the automatic tripping device 4 engaged with the latch 24 through a latch lever 27. Reference numeral 28 designates circular holes formed through interphase walls 1*c* of the breaker casing 1 through which passes the supporting shaft 25*a*, 25A and 29 designates a lever fixed on the supporting shaft 25*a*, 25A so as to engage the cradle 20*a* at the lower side. Reference numeral 30 designates a torsion spring for continuously urging the lever 29 in the direction for tripping the cradle 20*a* (that is, in the direction of an arrow 31), 32 designates an alarm switch for operating an alarm lamp, a buzzer, etc. when the circuit breaker is tripped, and 33 designates an actuator fixed on the supporting shaft 25 so as to engage with the alarm switch 32.

Next, a description will be made as to the operation of the circuit breaker. In the On state of the switching mechanism pole 1A shown in FIGS. 1 and 2, a current flows in the following path: the power source side fixed conductor 2→the fixed contact 3→the movable contact 6→the moving element 7→the flexible conductor 8→the connecting conductor 9→the automatic tripping device 4→the load side fixed conductor 5. In the ON state of the adjacent electrode 1B shown in FIGS. 1 and 3, on the other hand, a current flows in the following path: the power source side fixed conductor 2→the fixed contact 3→the movable contact 6→the moving element 7→the flexible conductor 8→the connecting conductor 9→the load side fixed conductor 5. When the operating handle 19 is set to the OFF state (in the direction of an arrow 34 in FIG. 2), the contact arm 10 is lifted by the switching mechanism 20, and the movable contact 6 is disconnected from the fixed contact 3 together with the moving element 7. At this time, since the second pin 16 is fitted in a recess portion 14*a* of the guide hole 14 by the tension spring 17, the second contact arm 10*b* is lifted by the switching mechanism 20 together with the first contact arm 10*a*. As a result, the second contact arm 10*b* rotates about the supporting shaft 12 and collides with the stopper pin 21 to thereby stop rotating. The rotation of the first contact arm 10*a* is transmitted to the first contact arm 10*a* of the adjacent pole 1B in FIG. 3 through the crossbar 13, and the contact arm 10 of the adjacent pole 1B is lifted in the same manner as in the switching mechanism pole 1A to thereby disconnect the movable contact 6 from the fixed contact 3 together with moving element 7.

When an overcurrent flows in the ON state depicted in FIGS. 1 and 2, the automatic tripping device 4 is actuated to rotate the latch 24 through the trip bar latch 26 and the latch lever 27 so that the cradle 20*a* is released from the latch 24 so as to jump up in the direction of the arrow 31 of FIG. 2. As a result, the contact arm 10 is lifted by the operation of the switching mechanism 20, and the movable contact 6 is disconnected so as to be tripped. Also at this time, the rotation of the first contact arm 10*a* is transmitted to the first contact arm 10*a* of the adjacent pole 1B in FIG. 3 through the crossbar 13, and the contact arm 10 of the adjacent pole 1B is lifted in the same manner as in the switching mechanism pole 1A so that the movable contact 6 is disconnected or tripped as shown in FIG. 5. When the cradle 20*a* is released from the latch 24 to jump up in the direction of the arrow 31, the lever 29 is rotated by the spring force of the torsion spring 30 in the direction of an arrow 35 in FIG. 2 so that the pole 1A is set in a tripped state as shown in FIG. 4. Further, the rotation of the lever 29 is transmitted to the actuator 33 through the supporting shaft 25 to thereby rotate the actuator 33 in the direction of an arrow 36 of FIG. 3 so that the adjacent pole 1B is set in a tripped state in FIG. 5 to thereby change over the connection of the alarm switch 32, that is, to generate an alarm informing that the breaker has been tripped.

Further, when a large current such as a short-circuit current or the like flows in the breaker of the illustrated type, the moving element 7 is repulsed against the fixed conductor 2 by the action of an electromagnetic force generated therebetween so that the moving element 7 is disconnected from the latter. In this case, the actuation of the switching mechanism 20 by the first contact arm 10*a* has a delay due to a relay time by the automatic tripping device 4. The second contact arm 10*b*, however, causes the second pin 16 to move away from the recess portion 14*a* against the force of the tension spring 17 to move in the guide hole 14 so that the second contact arm 10*b* rotates about the supporting shaft 12. It stops rotating when the second pin 16 collides against an end portion 14*b* of the guide hole 14. This repulsive movement is performed more rapidly than the operation of the switching mechanism 20 to which the moving element 7 is connected through the contact arm 10. Thus, the current limiting effect is enhanced.

Further in the case where, for example, while not shown in FIG. 1, an undervoltage tripping device is provided on an adjacent pole 1C disposed in opposition to the adjacent pole 1B so as to trip the circuit breaker when the voltage of the main circuit becomes lower than a predetermined value, an actuator (for example, 33) is attached to the opposite side (the upper side in FIG. 1) of the supporting shaft 25 so as to reset the undervoltage tripping device.

In the conventional multipole circuit breaker as described above, however, there has been a problem in that, because the supporting shaft 25 is inserted into the adjacent pole 1B through the circular hole 28 so as to couple the poles 1A and 1B with each other, the interphase insulation is lowered.

Moreover, in the conventional multipole circuit breaker as described above, because the hole 25*a* is formed through the supporting shaft 25 and the rivet 25*b* is inserted into the hole 25*a* so as to rivet the lever 29 and the supporting shaft 25 to each other, there have been problems that not only is the mechanical strength of the supporting shaft 25 remarkably reduced by the hole 25*a*, but also the fixing strength between the supporting shaft 25 and the lever 29 is reduced is the rivet 25*b* becomes loose.

Further, in the foregoing conventional multipole circuit breaker, when the actuator 33 is inserted and fixed onto one end portion of the supporting shaft 25, it is necessary not only to fix the actuator 33 and the supporting shaft 25 integrally with each other but to determine the attachment angle of the actuator 33 relative to the supporting shaft 25 taking the change-over point of the alarm switch 32 into consideration. Therefore, there has been a problem in that the assembly work is intricate.

SUMMARY OF THE INVENTION

The present invention has been attained to solve the foregoing problems in the prior art.

Accordingly, the invention provides a multipole circuit breaker in which interphase walls are passed by insulating caps inserted and fixed onto end portions of a supporting shaft to thereby improve the interphase insulating performance.

That is, in the multipole circuit breaker according to the present invention, the supporting shaft is made of metal, and the insulating caps are inserted and fixed onto the end portions of the supporting shaft so that the supporting shaft is passed at its insulating cap portions through the interphase walls and actuators are inserted and fixed onto the insulating caps. As a result, the interphase insulating performance is improved by the insulating caps.

In accordance with another aspect of the invention, the interphase insulation is further improved by the provision of retaining collars on the caps, so that the required assembly work is simplified.

According to this aspect of the present invention, the insulating caps are inserted and fixed onto the end portions of the supporting shaft so that the supporting shaft is passed at its insulating cap portions through the interphase walls to thereby improve the interphase insulation by the insulating caps. Further, the retaining collars for preventing falling off are formed on the insulating caps so that the insulation is further improved because the collars act as shielding plates. Moreover, during assembly, since the insulating caps are prevented from following off, the work steps required are simplified.

Another object of the invention is to provide a multipole circuit breaker in which no hole is formed though a supporting shaft so that the strength of the supporting shaft is increased and the fixing strength between the supporting shaft and a lever is remarkably improved.

In accordance with the above object, a multipole circuit breaker constructed according to another aspect of the present invention is provided with opposite side plate portions formed by bending opposite sides of the lever in the same direction, holes being formed through the opposite side plate portions so that the supporting shaft is inserted through the holes, and a recess portion formed in an outer peripheral surface of the supporting shaft so as to be fitted with the lever in the state where the recess portions abuts on the lever. Also, the supporting shaft and the lever are fixed to each other in such a manner that, after the supporting shaft is inserted through the opposite holes so as to fit the recess portions with the lever, the opposite side plate portions are knocked toward the supporting shaft so as to be tightly fitted with the supporting shaft.

As a result, the supporting shaft is hardly displaced in the axial and rotational directions because the recess portion is fitted with the lever, and hence the supporting shaft and the lever are firmly fixed to each other. Accordingly, it is not necessary to form any hole in the supporting shaft.

The multipole circuit breaker according to still another aspect of the present invention is arranged in such a manner that the supporting shaft is made of metal, and that insulating caps are inserted and fixed onto end portions of the supporting shaft so that the supporting shaft is passed at portions of the insulating caps through the interphase walls and the actuators are inserted and fixed onto the insulating caps, and that a fitting hole of each of the actuators and a portions of each of the insulating caps to be fitted into the fitting hole are formed with a one-directional fitting shape so as to attach the actuator in one direction.

Thus, according to this aspect of the present invention, when the insulating caps are inserted and fixed onto the end portions of the supporting shaft and the actuators are inserted and fixed onto the insulating caps, the attachment angles of the actuators are self determined and the actuators cannot be inserted onto the insulating caps at an erroneous angle.

Yet another object of the invention is to provide a multipole circuit breaker in which no hole is formed though a supporting shaft so that the strength of the supporting shaft is increased, the fixing strength between the supporting shaft and a lever is remarkably improved, and the surface working of the supporting shaft can be easily carried out.

In satisfaction of this object, a multipole circuit breaker according to the present invention is further provided with opposite side plate portions formed by bending opposite sides of the lever in the same direction, holes being formed through the opposite side plate portions so that the supporting shaft is inserted through the holes, and a recess portion being formed in an outer peripheral surface of the supporting shaft so as to be fitted with the lever in the state where the recess portions abuts the lever. The supporting shaft and the lever are fixed to each other in such a manner that, after the supporting shaft is inserted through the opposite holes so as to make the recess portion fit the lever, the opposite side plate portions are knocked toward the supporting shaft so a to be closely fitted with the supporting shaft. Insulating caps are inserted and fixed onto end portions of the supporting shaft at which flat engagement surfaces for preventing displacement are formed so that the supporting shaft is passed at its insulating cap portions through the interphase walls and the actuators are inserted and fixed onto the insulating caps. Flat surfaces of the recess portion and the flat engagement surfaces of the supporting shaft are formed so as to form the same angles with respect to the longitudinal axis of the shaft.

Therefore, the supporting shaft is hardly displaced in the axial and rotational directions because the recess portion is fitted with the lever, and thus the supporting shaft and the lever are firmly fixed to each other. Accordingly, it is not necessary to form any hole through the supporting shaft. Further, the flat surface of the recess portion and the flat engagement surfaces of the supporting shaft are formed so as to have the same angles relative to the shaft center so that the surface working of the supporting shaft can be easily performed.

DESCRIPTION OF THE PREFERRED EMBODIMENTS

Figure 1:
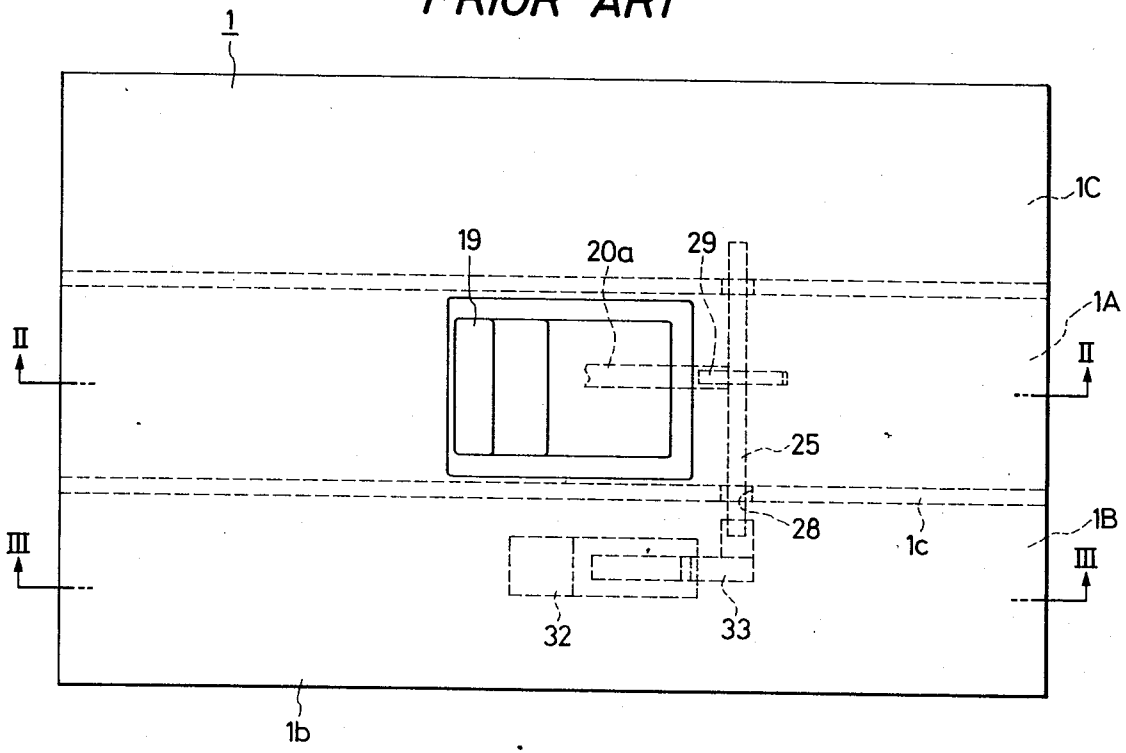
FIG. 1 PRIOR ART
FIG. 1 is a front view showing a conventional multipole circuit breaker.
Figure 2:
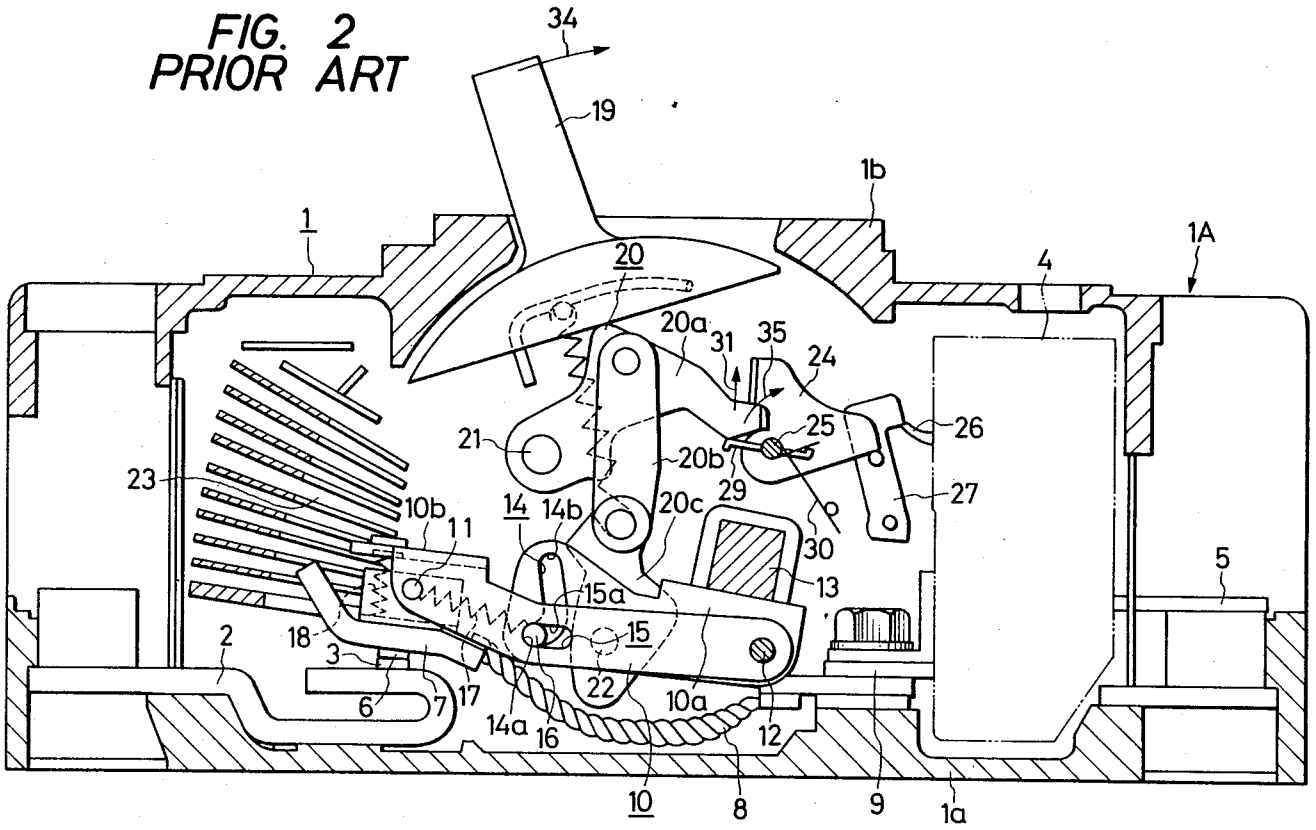
FIG. 2 PRIOR ART
FIG. 2 is an enlarged sectional view taken on a line II—II in FIG. 1.
Figure 3:
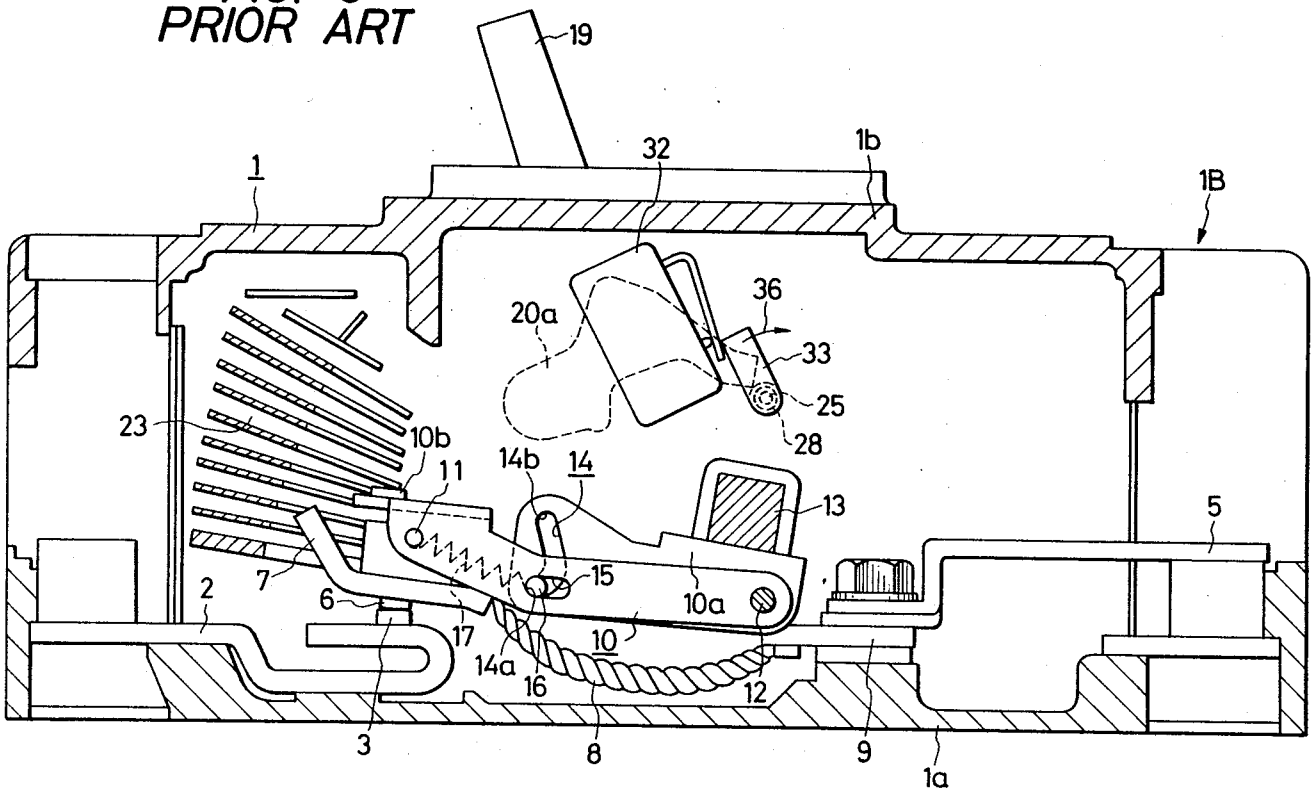
FIG. 3 PRIOR ART
FIG. 3 is an enlarged sectional view taken on a line III—III in FIG. 1.
Figure 4:
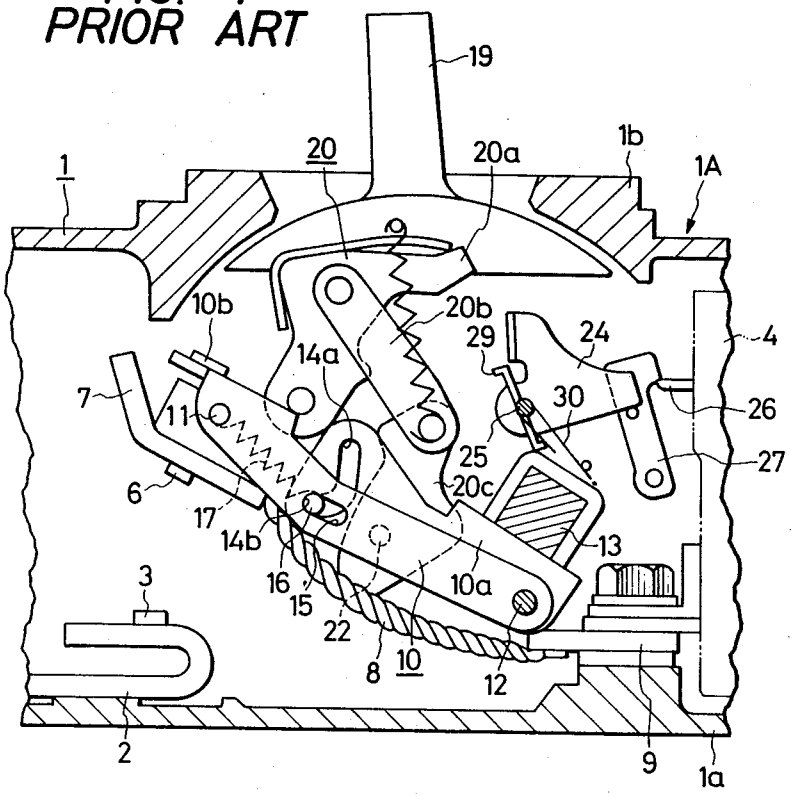
FIG. 4 PRIOR ART
FIG. 4 is a partial view of FIG. 2 showing a tripped state.
Figure 5:
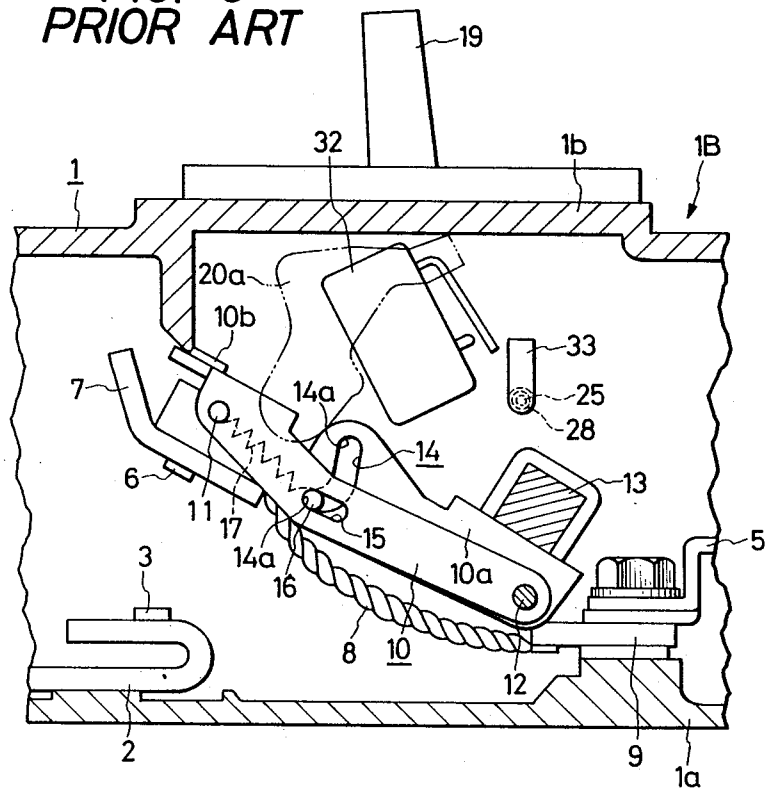
FIG. 5 PRIOR ART
FIG. 5 is a partial view of FIG. 3 showing a tripped state.
Figure 6:
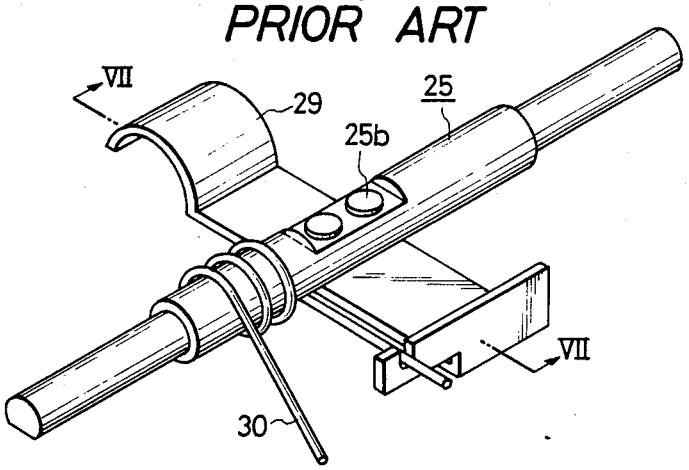
FIG. 6 PRIOR ART
FIG. 6 is a perspective view of the supporting shaft with the lever attached thereon.
Figure 7:
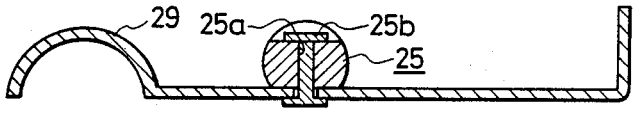
FIG. 7 PRIOR ART
FIG. 7 is a sectional view taken on a line VII—VII in FIG. 6.
Figure 8:
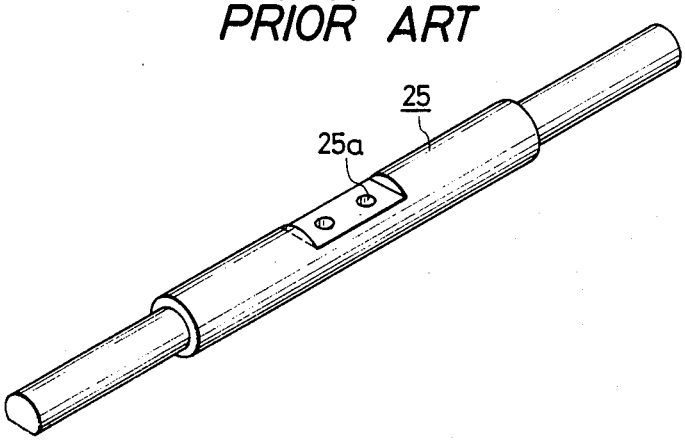
FIG. 8 PRIOR ART
FIG. 8 is a perspective view of the supporting shaft.
Figure 9:
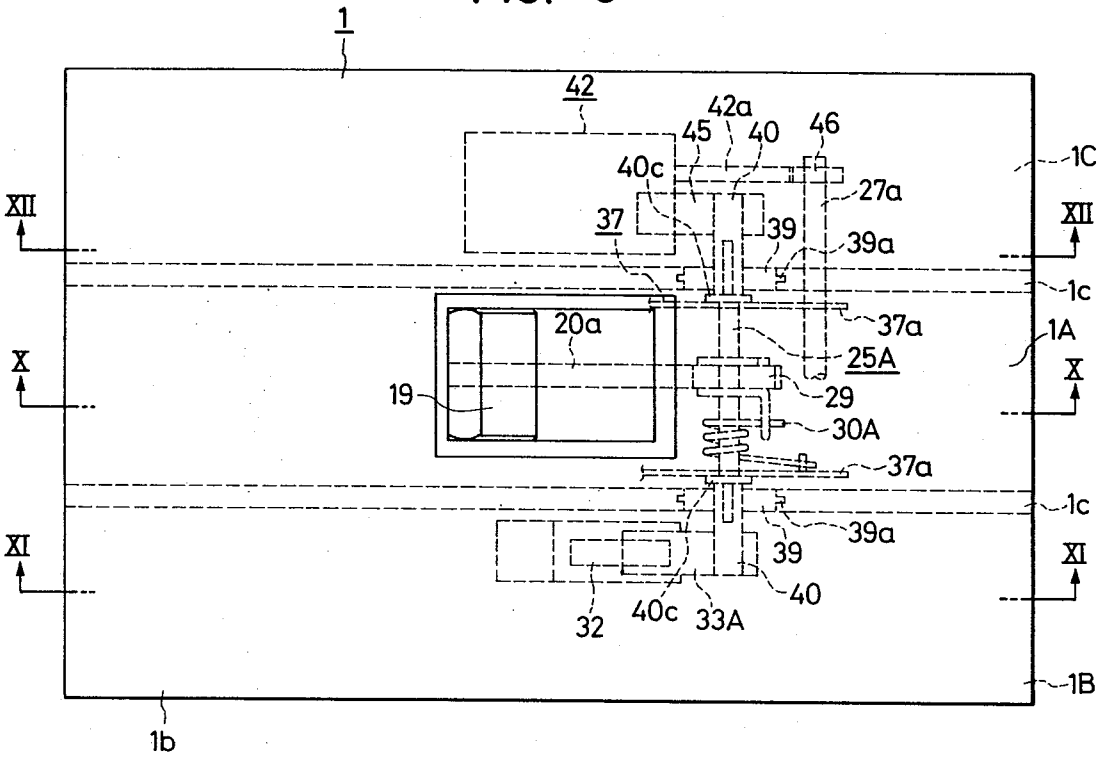
FIG. 9 is a front view showing a first embodiment of a multipole circuit breaker of the present invention.
Figure 10:
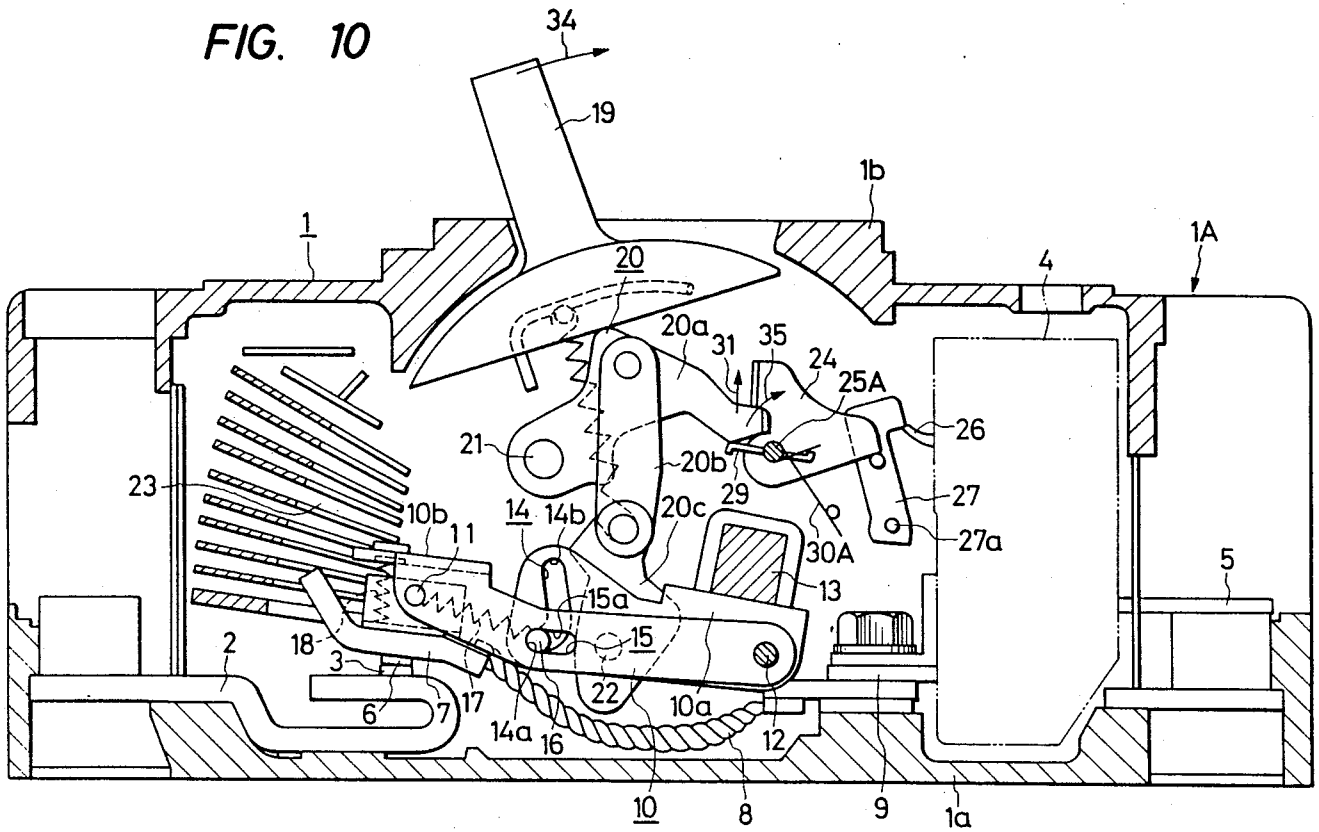
FIG. 10 is an enlarged sectional view taken on line X—X in FIG. 9.
Figure 11:
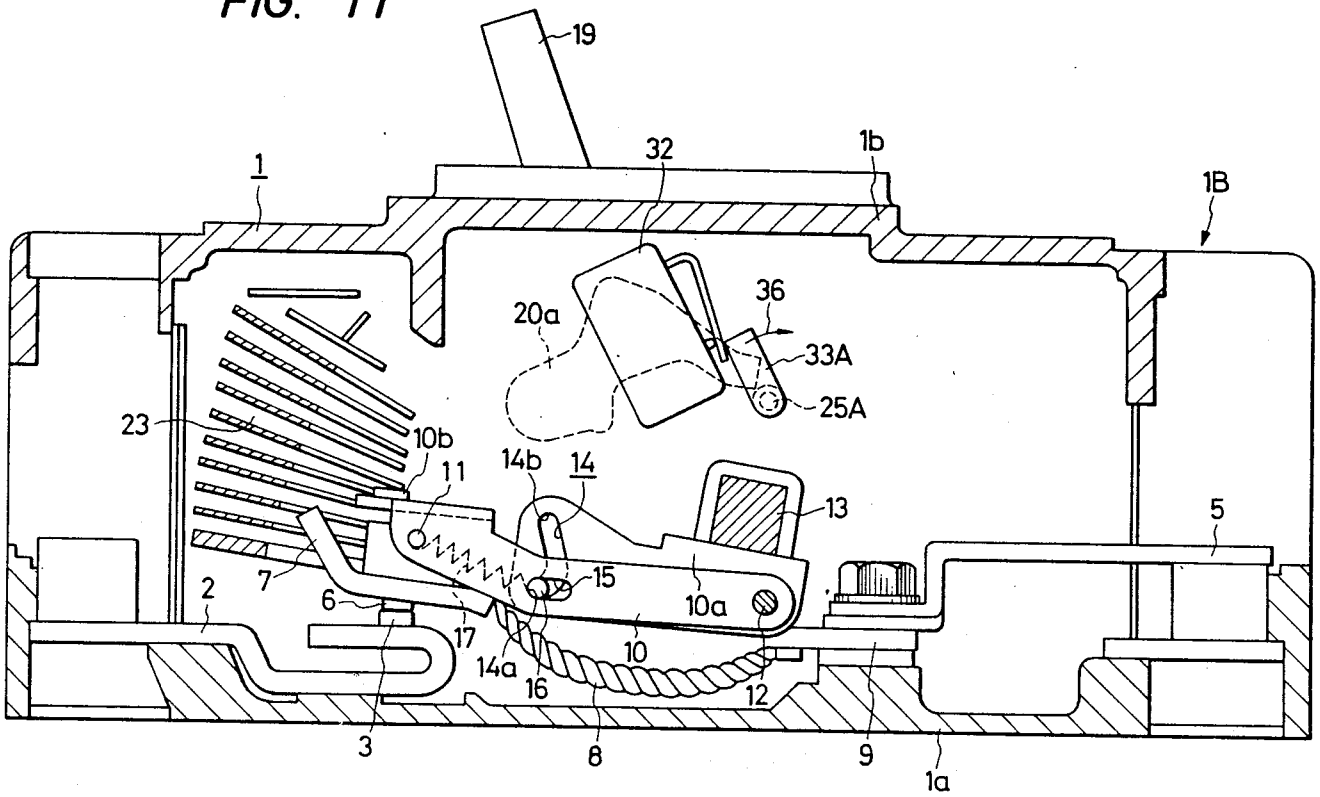
FIG. 11 is an enlarged sectional view taken on a line XI—XI in FIG. 9.
Figure 12:
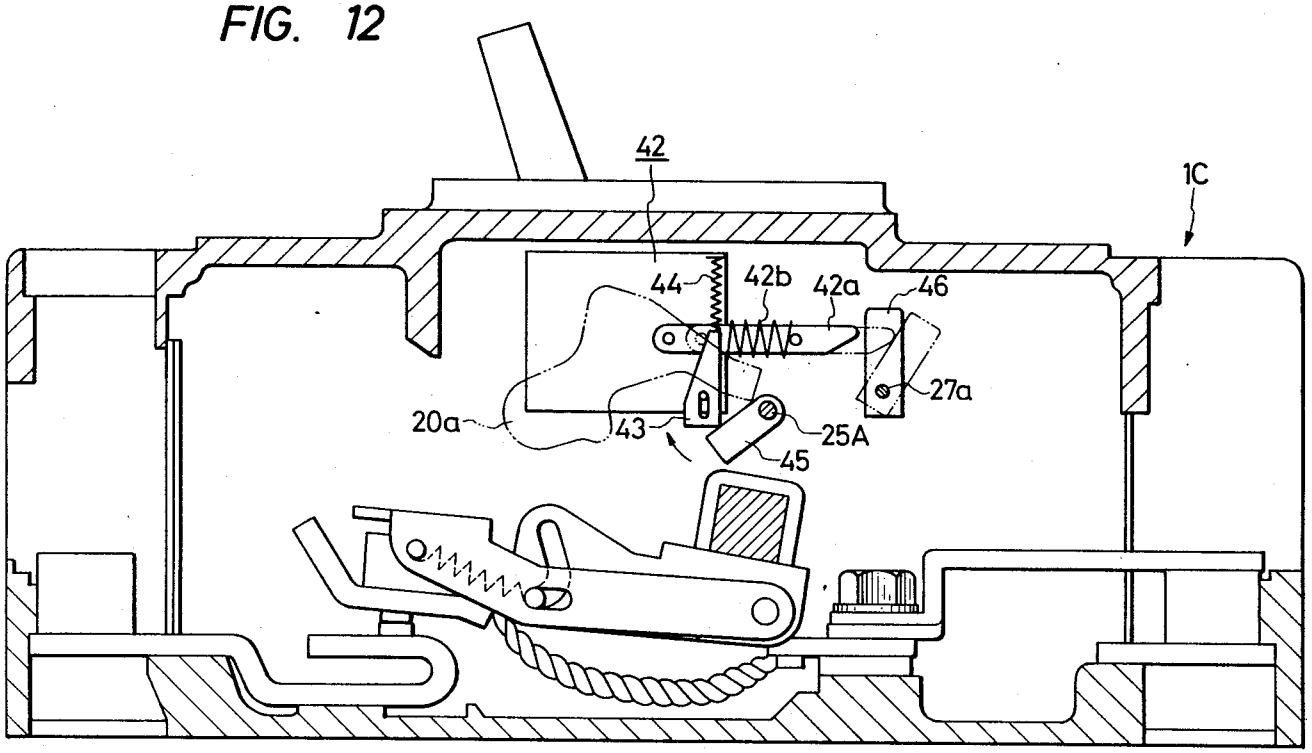
FIG. 12 is an enlarged sectional view taken on a line XII—XII in FIG. 9.
Figure 13:
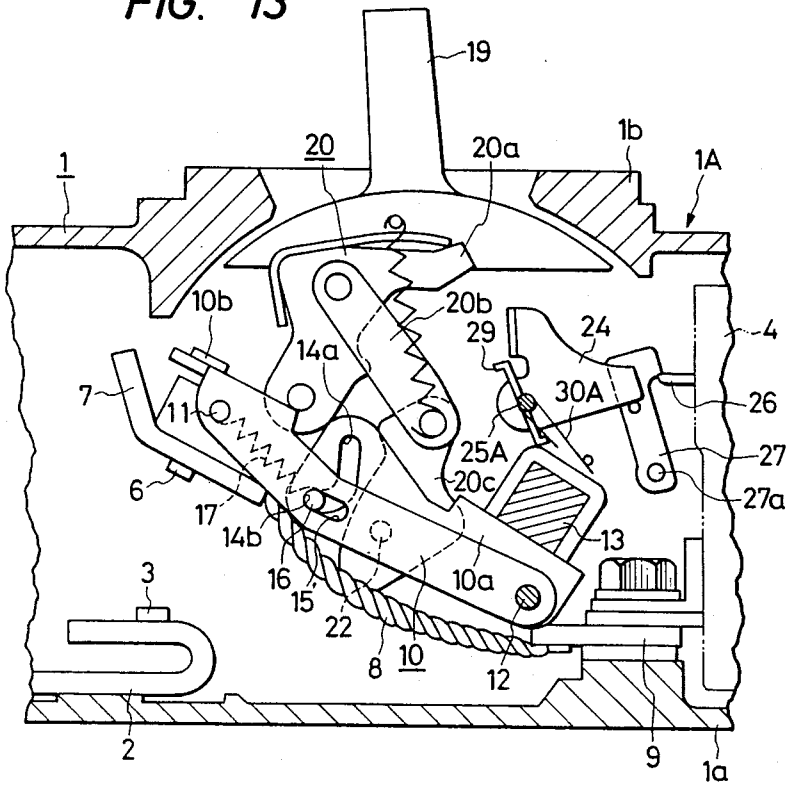
FIG. 13 is a partial view of FIG. 10 showing a tripped state.
Figure 14:
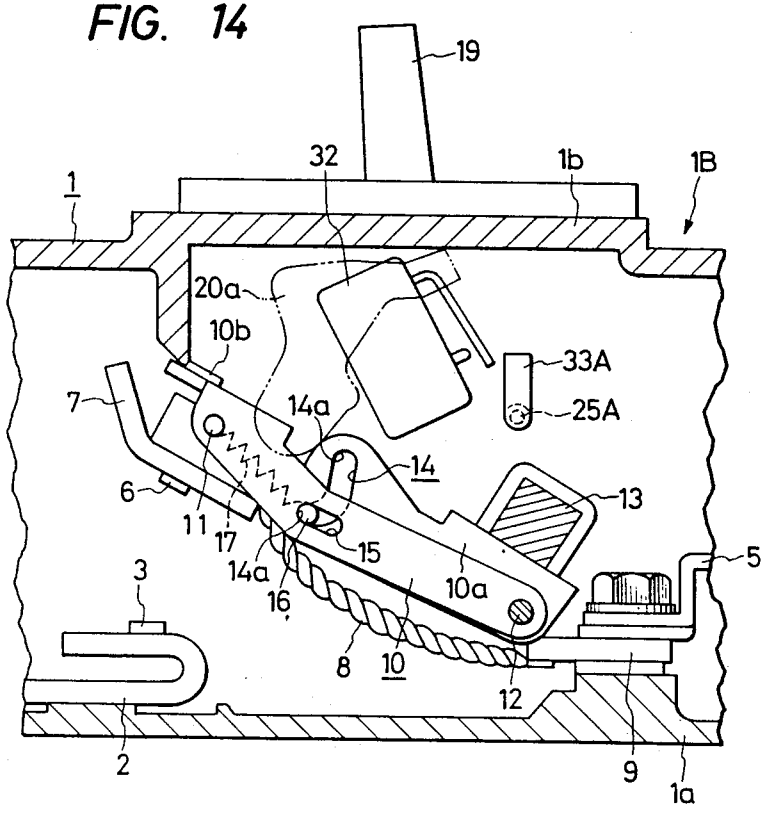
FIG. 14 is a partial view of FIG. 11 showing a tripped state.
Figure 15:
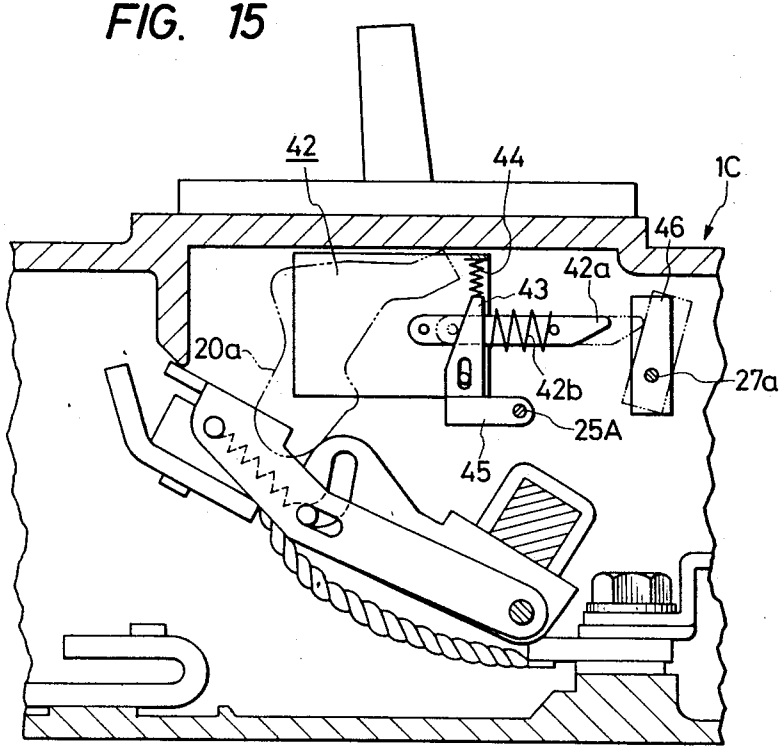
FIG. 15 is a partial view of FIG. 12 showing a tripped state.
Figure 16:
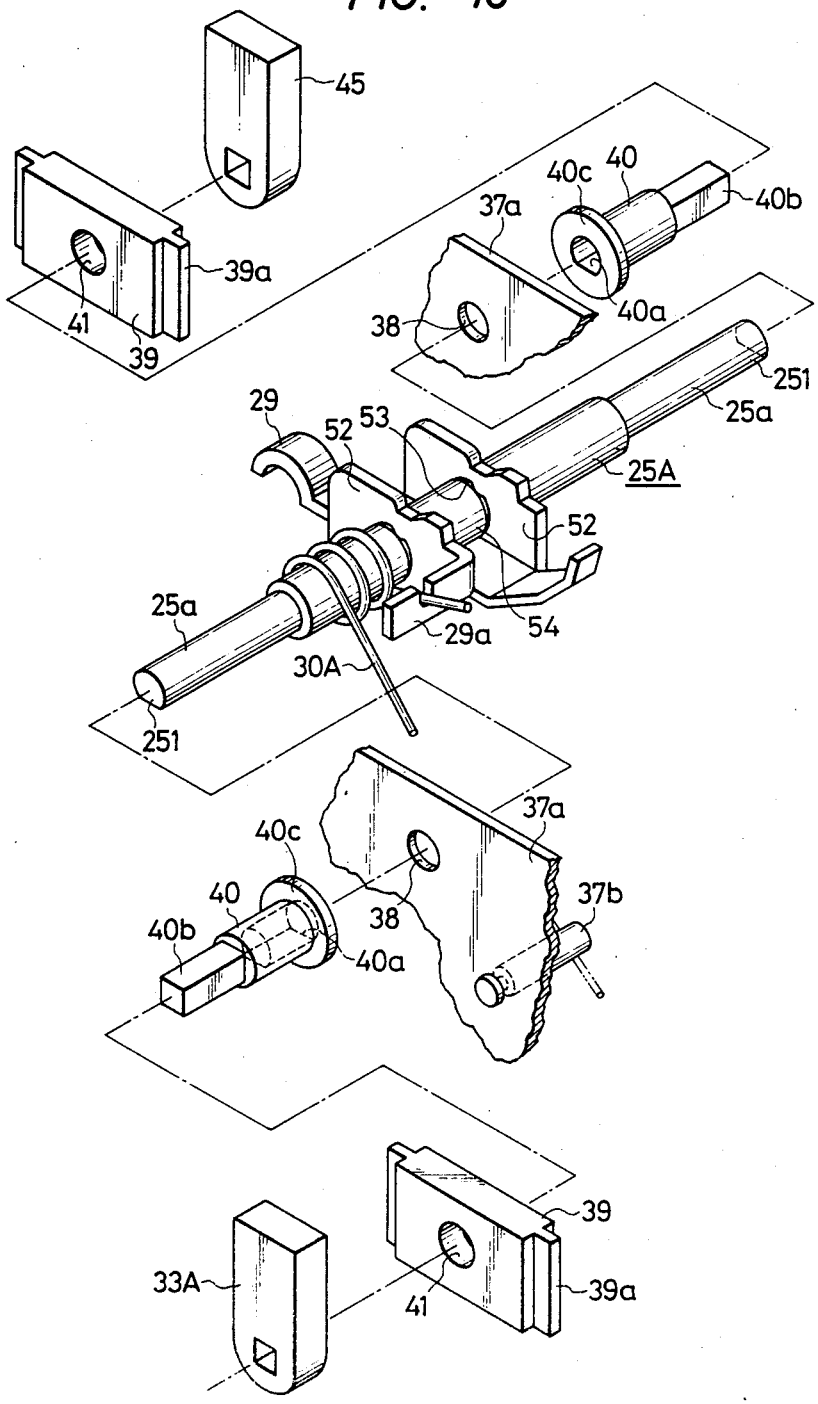
FIG. 16 is an exploded perspective view showing main portion of the breaker.

Referring to FIGS. 9 through 16, a first preferred embodiment of the present invention will be described. FIG. 9 is a front view, FIG. 10 is an enlarged sectional view taken on a line X—X in FIG. 9, FIG. 11 is an enlarged sectional view taken on a line XI—XI of FIG. 9, FIG. 12 is an enlarged sectional view taken on a line XII—XII in FIG. 9, FIG. 13 is a partial view of FIG. 10 showing a tripped state, FIG. 14 is a partial view of FIG. 11 showing a tripped state, FIG. 15 is a partial view of FIG. 12 showing a tripped state, and FIG. 16 is an exploded perspective view showing main portions of the breaker of this embodiment of the invention. Portions the same as or corresponding to those in the foregoing conventional arrangement are referenced correspondingly, and a further detailed explanation thereof is omitted.

In these drawings, reference numeral 25A designates a supporting shaft, made of metal, having its opposite end portion **25*a* passing through interphase walls 1*c* on the opposite sides. Reference numeral 37 designate a frame fixed on a base 1*a* of a switching mechanism pole 1A, the frame 37 having opposite side plates 37*a*. Reference numeral 38 designates supporting shaft insertion holes formed in the opposite side plates 37*a*, and 39 designates interphase barriers fitted in the interphase walls 1*c*, each interphase barrier 39 and the corresponding interphase wall 1*c* being fitted with each other through projections 39*a* on the barriers 39 and corresponding grooves in the walls 1*c*. Reference numeral 40 designates insulating caps inserted and fixed onto the opposite end portions 25*a* of the supporting shaft 25A. A flat surface portion 40*a* of each insulating cap 40 is fittingly engaged with a flat surface portion 251 of the end portion 25*a* so as to perform positioning of the insulating cap 40 relative to the supporting shaft 25A in the rotational direction. Reference numeral 40*c* designates retaining collars formed on the respective insulating caps 40 which abut on the interphase barriers 39 from the switching mechanism pole 1A side. Reference numeral 41 designate cap insertion holes formed through the interphase barriers 39 and 42 designates an undervoltage tripping device provided on an adjacent pole 1C and having a movable iron core 42***a* which is projected in the tripped state and having a pushing spring 42*b* for urging the movable iron core 42*a* in the projecting direction. Reference numeral 43 designates a reset lever for the undervoltage tripping device 42, the reset lever being engaged with the movable iron core 42*a*. Reference numeral 44 designates a pushing spring for urging the reset lever 43 in the anti-reset direction (in the direction opposite to an arrow in FIG. 12), and 45 designates an actuator for actuating the reset lever 43, the actuator 45 being inserted and fixed in the positioned state on a rectangular shaft portion 40*b* of one insulating cap 40. Reference numeral 46 designates a trip bar fixed on a supporting shaft 27*a* of a latch lever 27 so as to be actuated by the movable iron core 42*a*. Further, an actuator 33A is inserted onto a rectangular shaft portion 40*b* of the other insulating cap 40, and a torsion spring 30A engages with a spring engagement piece 29*a* of a lever 29 and a projection 37*b* of the switching mechanism frame 37.

In the state as shown in FIG. 16 (a state where the supporting shaft 25A has been inserted through the supporting shaft insertion holes 38 of the switching mechanism frame 37), the insulating caps 40 are inserted from the collar 40*c* side onto the opposite end portions 25*a* of the supporting shaft 25A projected outside from the opposite side plates 37*a* and fitted into the interphase barriers 39. Then the interphase barriers 39 ar fitted into the interphase walls 1*c* so that the multipole circuit breaker is assembled as shown in FIG. 9.

When the voltage on the main circuit reaches a value lower than a predetermined value in the ON state depicted in FIGS. 9 through 12 and the undervoltage tripping device 42 is actuated to project the movable iron core 42*a* as shown by a phantom line in FIG. 12, the trip bar 46 rotates (clockwise) as shown by a phantom line in FIG. 12, that is, the latch lever 27 is rotated clockwise in FIG. 10 by the supporting shaft 27*a*, and thus a latch 24 is released to cause a cradle 20*a* jump up in the direction of an arrow 31 in FIG. 10 to thereby perform tripping. Thus, the switching mechanism pole 1A is brought into the state shown in FIG. 13. Further, as shown in FIG. 14, the actuator 33A is rotated by the rotation of the supporting shaft 25A so that the connection of an alarm switch 32 is switched to generate an alarm. At this time, the actuator 45 is also rotated by the supporting shaft 25A in the direction of the arrow in FIG. 12 to thereby push the reset lever 43 upward so as to reset the movable iron core 42*a* as shown in FIG. 15. Although the movable iron core 42*a* may be reset by a attractive force due to the recovery of a rated voltage after tripping by the undervoltage tripping device 42, the reset operation movable iron core 42*a* is mechanically returned by the reset lever 43 as described above so as to make the reset operation sure.

By inserting and fixing the insulating caps 40 onto the end portions 25*a* of the supporting shaft 25A so that the interphase walls 1*c* are passed by the portions of the insulating caps 40 in the manner as described above, the interphase insulation is improved by the insulating caps 40. Further, by the provision of the insulating caps 40, a metal rod can be used as the supporting shaft 25A, and therefore the supporting shaft 25A can be decreased in size.

Moreover, by forming the collars 40*c* on the insulting caps 40, the interphase insulation is further improved because the collar 40*c* closes the cap insertion hole 42 and acts as a shielding plate at the switching mechanism pole 1A side. Further, during assembly the insulating caps are prevented from falling off by the presence of the collars 41, and hence the assembly work is simplified.

Further, the changeover between the alarm switches 32 on the left and right poles and the resetting of the undervoltage tripping device 42 can be performed by one supporting shaft 25A, and therefore the arrangement of the multipole circuit breaker can be simplified and the parts of the same can be standardized.

Figure 17:
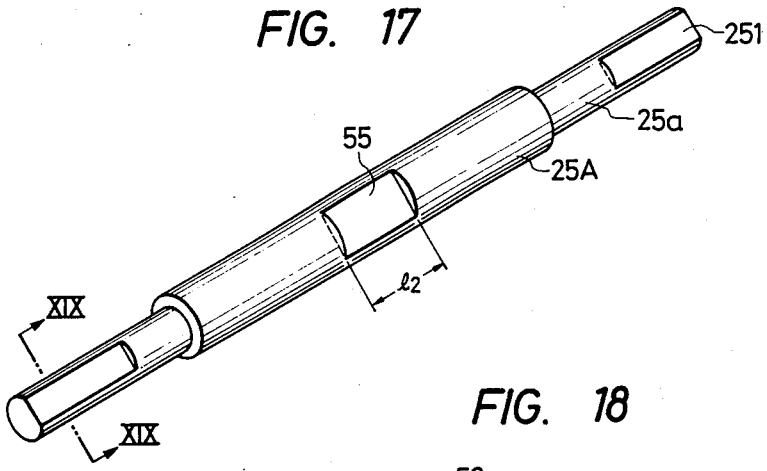
FIGS. 17 and 18 are perspective views showing the state of a supporting shaft and the lever before fixed in accordance with another embodiment.
Figure 18:
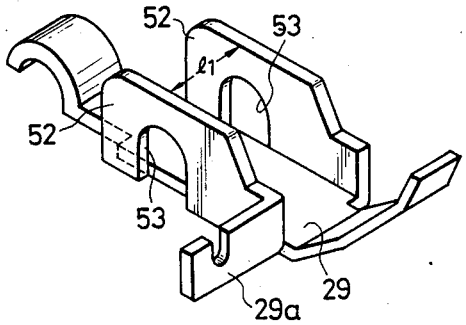
Figure 19:
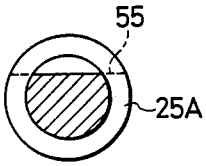
FIG. 19 is a sectional view taken on a line XIX—XIX in FIG. 17.
Figure 20:
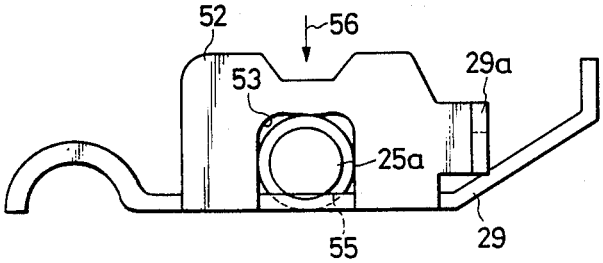
FIG. 20 is a side view showing the fixed state of the supporting shaft and the lever.

Other features of the present invention will be described in reference to FIGS. 17 through 20. FIGS. 17 and 18 are perspective views respectively showing the supporting shaft and the lever before assembly, FIG. 19 is a sectional view taken on a line XIX—XIX in FIG. 17, and FIG. 20 is a side view showing the assembled state of the supporting shaft and the lever. Portions the same as or corresponding to those in the above arrangement are referenced correspondingly, and a further detailed explanation is omitted.

In these drawings, the reference numerals 52 designate opposite side plate portions formed by bending opposite sides of the lever 29 by 90 degrees in the same direction so that the opposite side plate portions 52 are parallel to each other, and 53 designates opposite holes formed through the opposite side plate portions 52 so that the supporting shaft 25*a*, 25A is inserted therethrough. Reference numeral 55 designates a recess formed in the central portion of the supporting shaft 25A, the recess 39 having a length $l_2$ corresponding to the width $l_1$ of the lever 29 so as to be fitted with the lever 29 in the axial direction, and having a flat portion extending in the tangential direction so as to abut the lever 29 in the direction perpendicular to the axial direction.

After the supporting shaft 25A is turned over from the state shown in FIG. 17 and inserted through the opposite holes 53 of the lever 29 so as to cause the recess portion 55 to fit with the lever 29, the opposite side plate portions 52 are knocked toward the supporting shaft 25A, as shown by an arrow 56 in FIG. 20, so as to be closely fitted to the supporting shaft 25A. In the foregoing state (in the state of FIGS. 16 and 20), the supporting shaft 25A is fixed in the opposite holes 53 in the state where the recess portion 55 is fitted with the lever 29. Therefore, the supporting shaft 25A is hardly displaced in the axial direction because step portions of the recess portion 55 engage with end surface of the lever 29 and hardly rotates in the rotational direction because the flat surface of the recess portion 55 abuts the lever 29. Accordingly, the supporting shaft 25A and the lever 29 are firmly fixed to each other.

As further described above, according to the present invention, the strength of the supporting shaft is enhanced and the fixing strength between the supporting shaft and the lever is remarkably improved because it is not necessary to from any hole through the supporting shaft.

Figure 21:
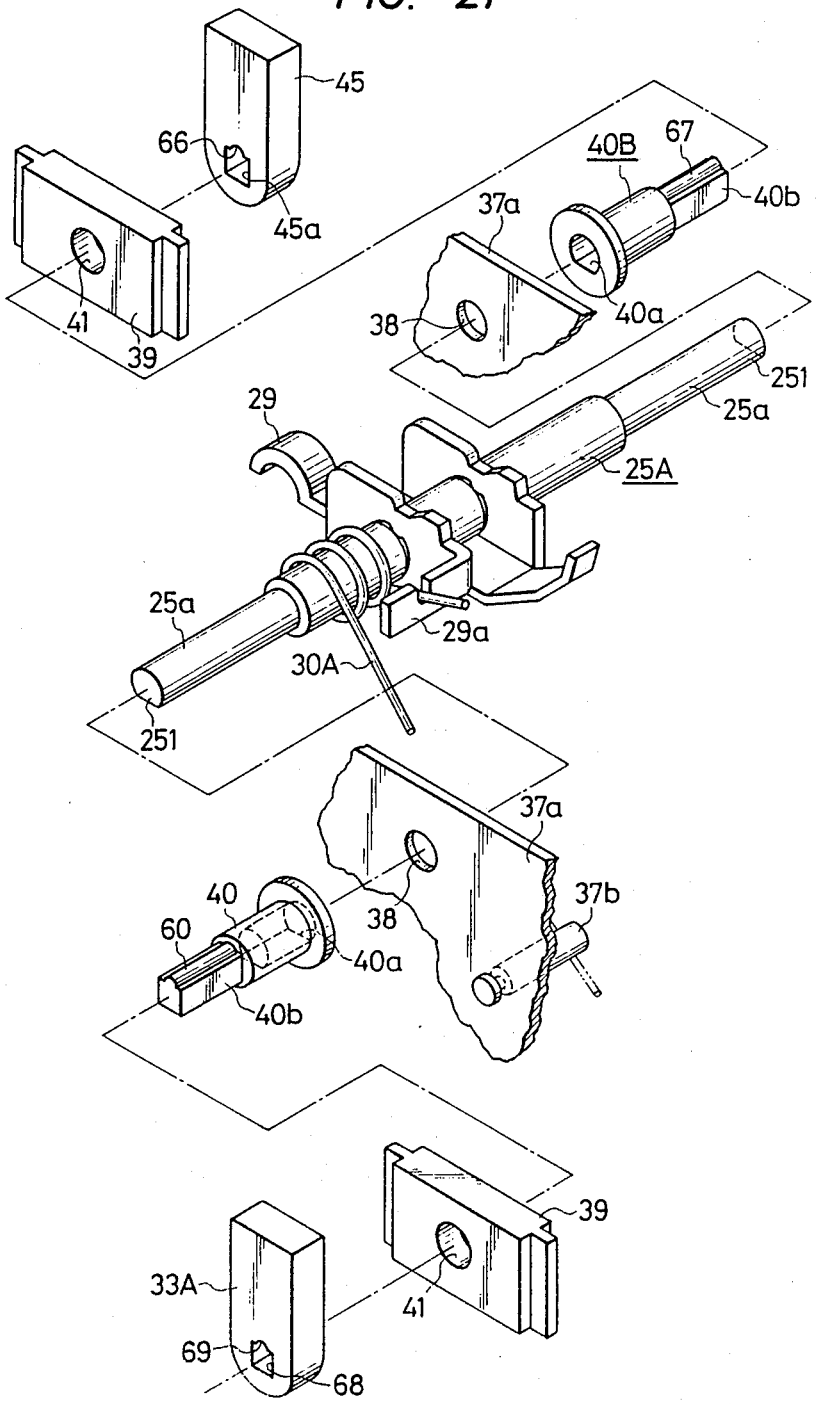
FIG. 21 is an exploded perspective view showing main portions of yet another embodiment of a multipole circuit breaker of the invention.

Referring again to FIG. 21, reference numeral 45 designates an actuator inserted and fixed via a rectangular hole 45*a* onto a rectangular shaft portion 40*b* of one insulating cap 40 for operating the reset lever 43. Reference numeral 66 designates a longitudinal groove formed in one of surfaces of the actuator rectangular hole 45*a*, and 67 designates a longitudinal projection formed on one of surfaces of the rectangular shaft portion 40*b* of the insulating cap 40 so as to fit with the longitudinal groove 66. Reference numeral 33A designates an actuator inserted and fixed at its rectangular hole 68 onto a rectangular shaft portion 60 of the other insulting cap 40 for operating an alarm switch 32. Reference numeral 69 designates a longitudinal groove formed in one of surfaces of the actuator rectangular hole 68, and 60 designates a longitudinal projection formed on one of the surfaces of the rectangular shaft portion 40*b* of the insulating cap 40 so as to fit with the longitudinal groove 69.

In the arrangement in which the longitudinal projection 67 and 60 are formed on the rectangular shaft portions 40*b* of the respective insulating cas 40, and the longitudinal grooves 66 and 69 are formed in the rectangular holes 45 as and 69 of the actuators 45 and 33A, respectively, it is possible to set the angles (direction) of the respective actuators 45 and 33A during assembly only by fixedly inserting the actuators 45 and 33A onto the rectangular shaft portions 40*b* of the respective insulating caps 40 so as to fit the longitudinal projections 67 and 60 in the longitudinal grooves 66 and 69, respectively. At this time, it is necessary to previously set the angle of the rectangular hole 45*a* of the actuator 45 relative to the rectangular shaft portion 40*b* of the respective insulating cap 40 and the angle of the rectangular hole 68 of the actuator 33A relative to the rectangular shaft portion 40*b* of the other insulating cap 40. As a result, the assembly of the actuators 45 and 33A is limited to only one predetermined direction. Hence, not only are the angles of the actuators 45 and 33A automatically determined when the actuators 45 and 33A are inserted and fixed on the caps, but attachment at erroneous angles is prevented.

In the foregoing embodiment, if a difference in attachment angle between the actuators 45 and 33A is made equal to a difference in angle between the rectangular shaft portions 40*b* of the respective insulating caps 40 as well as a difference in angle between the longitudinal projections 67 and 60, the actuators 45 and 33A may be formed to have the same shape. Further, if the flat surface positions 251 of the opposite end portions 25*a* of the supporting shaft 25A are formed to have an angle equal to a difference in the attachment angle between the actuators 45 and 33A, the insulating caps 40 may have the same shape and the actuators 45 and 33A may have the same shape so that production can be made easy and inexpensive.

As described above, according to the present invention, the interphase insulation is improved because the interphase walls are passed by the insulating caps inserted and fixed onto the end portions of the supporting shaft.

As further described above, according to another aspect of the present invention, the interphase walls are passed by the insulating caps inserted and fixed on the opposite end portions of the supporting shaft so that the interphase insulation is improved, and the retaining collars are formed on the insulating caps. Hence, not only is the interphase insulation further improved, but the assembly work is simplified.

As further described above, according to the present invention, the strength of the supporting shaft is enhanced and the fixing strength between the supporting shaft and the lever is remarkably improved because it is not necessary to form any hole through the supporting shaft.

Also as described above, according to the present invention, the attachment angles of the actuators are determined only by inserting the actuators onto the insulating caps, so that the assembly work can be easily performed and assembly at an erroneous attachment angle is prevented, to thereby obtain superior workability.

What is claimed is:

1. A multipole circuit breaker provided with a mechanism pole having a switching mechanism, and adjacent poles each disposed in opposition to said mechanism pole with an interphase wall disposed therebetween and each having an internal attachment comprising an alarm switch but having no switching mechanism, said circuit breaker comprising: a latch engaged with a cradle of said switching mechanism and arranged to be actuated by an automatic tripping device, a supporting shaft for rotatably supporting said latch, a lever fixed on said supporting shaft so as to engage with said cradle, means for urging said lever in a direction to trip said cradle, actuators fixed on said supporting shaft so as to engage with said internal attachments of respective ones of said adjacent poles, said supporting shaft being made of metal, and insulating caps inserted and fixed onto end portions of said supporting shaft so that said supporting shaft is passed at portions of said insulating caps through said interphase walls and said actuators are inserted and fixed onto said insulating caps.

2. The multipole circuit breaker according to claim 1 in which said adjacent poles are disposed on respective opposite sides of said switching mechanism pole and provided with an alarm switch and an undervoltage tripping device as said internal attachments, said insulating caps being inserted and fixed onto said opposite end portions of said supporting shaft so that change-over of said alarm switch and reset of said undervoltage tripping device are performed by said actuators inserted and fixed onto said insulating caps.

3. A multipole circuit breaker provided with a mechanism pole having a switching mechanism, and adjacent poles each disposed in opposition to said mechanism pole with an interphase wall disposed therebetween and each having an internal attachment comprising an alarm switch but having no switching mechanism, said circuit breaker comprising: a latch engaged with a cradle of said switching mechanism and arranged to be actuated by an automatic tripping device, a supporting shaft for rotatably supporting said latch, a lever fixed on said supporting shaft so as to engage with said cradle, means for urging said lever in a direction to trip said cradle, actuators fixed on said supporting shaft so as to engage with said internal attachments of said adjacent poles, said supporting shaft being made of metal, insulating caps inserted and fixed onto end portions of said supporting shaft so that said supporting shaft is passed at portions of said insulating caps through said interphase walls and said actuators are inserted and fixed onto said insulating caps, and retaining collars formed on said insulating caps so as to abut side surfaces of said interphase walls at said switching mechanism pole side.

4. The multipole circuit breaker according to claim 3, further comprising interphase barriers fittingly attached to said interphase walls by means of a projection and a groove, said insulating caps being rotatably inserted in holes of said interphase barriers.

5. A multipole circuit breaker provided with a mechanism pole having a switching mechanism, and an adjacent pole disposed adjacent to said mechanism pole and having an internal attachment comprising an alarm switch but having no switching mechanism, said circuit breaker comprising: a latch engaged with a cradle of said switching mechanism and arranged to be actuated by an automatic tripping device, a supporting shaft for rotatably supporting said latch, a lever fixed on said supporting shaft so as to engage with said cradle, means for urging said lever in a direction to trip said cradle, and an actuator fixed on said supporting shaft so as to engage with said internal attachment of said adjacent pole, opposite side plate portions formed by bending opposite sides of said lever in the same direction, holes being formed through said opposite side plate portions, said supporting shaft being inserted through said holes, a recess portion being formed in an outer peripheral surface so said supporting shaft so as to be fitted with said lever in the state where said recess portion abuts said lever, and said supporting shaft and said lever being fixed to each other in such a manner that, after said supporting shaft is inserted through said opposite holes so as to fit said recess portion with said lever, said opposite side plate portions are knocked toward said supporting shaft so as to be hightly fitted with said supporting shaft.

6. A multipole circuit breaker provided with a mechanism pole having a switching mechanism, and adjacent poles each disposed in opposition to said mechanism pole with an interphase wall disposed therebetween and each having an internal attachment comprising an alarm switch but having no switching mechanism, said circuit breaker comprising: a latch engaged with a cradle of said switching mechanism and arranged to be actuated by an automatic tripping device, a supporting shaft for rotatably supporting said latch, a lever fixed on said supporting shaft so as to engage with said cradle, means for urging said lever in a direction to trip said cradle, actuators fixed on said supporting shaft so as to engage said internal attachments of said adjacent poles, said supporting shaft being made of metal, and insulating caps inserted and fixed onto end portions of said supporting shaft so that said supporting shaft is passed at portions of said insulating caps through said interphase walls and said actuators are inserted and fixed onto said insulating caps, and a fitting hole of each of said actuators and a portion of each of said insulating caps to be fitted into said fitting hole being formed so as to have a one-directional fitting shape so as to attach said actuator in one predetermined direction.

7. The multipole circuit breaker according to claim 6, in which said fitting hole of said actuator is rectangular, said portion of said insulating cap to be fitted in said fitting hole is a rectangular shaft portion corresponding in shape to said rectangular hole, and uneven fitting portions are formed in respective abutment surfaces of said rectangular hole and said rectangular shaft.

8. The multipole circuit breaker according to claim 7, in which a longitudinal groove is formed in one surface of said rectangular hole of said actuator and a longitudinal projection is formed on one surface of said rectangular shaft of said insulating cap.

9. The multipole circuit breaker according to claim 6, in which said adjacent poles are disposed on opposite sides of said switching mechanism pole and provided with an alarm switch and an undervoltage tripping device as said internal attachments said insulating caps being inserted and fixed onto said opposite end portions of said supporting shaft, a fitting hole of each of said actuators and a portion of each of said insulating caps to be fitted into said fitting hole being formed to have a one-directional fitting shape so as to attach said actuator in one predetermined direction, and change-over of said alarm switch and reset of said undervoltage tripping device being performed by said actuators inserted and fixed onto said insulating caps.

10. A multipole circuit breaker provided with a mechanism pole having a switching mechanism, and adjacent poles each disposed in opposition to said mechanism pole with an interphase wall disposed therebetween and each having an internal attachment comprising an alarm switch but having no switching mechanism, said circuit breaker comprising; a latch engaged with a cradle of said switching mechanism and arranged to be actuated by an automatic tripping device, a supporting shaft for rotatably supporting said latch, a lever fixed on said supporting shaft so as to engaged with said cradle, means for urging said lever in a direction to trip said cradle, actuators fixed on said supporting shaft so as to engage with said internal attachments so said adjacent poles respectively, opposite side plate portions formed by bending opposite sides of said lever in the same direction, holes being formed through said opposite side plate portions, said supporting shaft being inserted through said holes, and a recess portion being formed in an outer peripheral surface of said supporting shaft so as to be fitted with said lever in a state where said recess portion abuts said lever, said supporting shaft and said lever being fixed to each other in such a manner so that, after said supporting shaft is inserted through said opposite holes so as to make said recess portion fit with said lever, said opposite side plate portions are knocked toward said supporting shaft so as to be fitted with said supporting shaft, insulating caps inserted and fixed onto end portions of said supporting shaft at which flat engagement surfaces for preventing displacement are formed, said supporting shaft being passed at its insulating cap portions through said interphase walls and said actuators are inserted and fixed onto said insulating caps respectively, flat surfaces of said recess portions and said flat engagement surfaces of said supporting shaft being formed so as to form the same angles with respect to an axis of said shaft.

11. The multipole circuit breaker according to claim 10, in which said adjacent poles are disposed on opposite sides of said switching mechanism pole, and provided with an alarm switch and an undervoltage tripping device as said internal attachments said supporting shaft being made of metal, and further comprising insulating caps inserted and fixed onto end portions of said supporting shaft, said supporting shaft being passed at portions of said insulating caps through said interphase wall, said actuator being inserted and fixed onto said insulating caps so that changeover of said alarm switch and reset of said undervoltage tripping device are performed by said actuators inserted and fixed onto said insulating caps.

* * * * *